US009490530B2

(12) United States Patent
Chen et al.

(10) Patent No.: US 9,490,530 B2
(45) Date of Patent: Nov. 8, 2016

(54) NFC ANTENNA ASSEMBLY AND MOBILE COMMUNICATION DEVICE COMPRISING THE SAME

(71) Applicant: BYD COMPANY LIMITED, Guangdong (CN)

(72) Inventors: Yajuan Chen, Guangdong (CN); Jiangang Zhou, Guangdong (CN); Dajun Chen, Guangdong (CN)

(73) Assignee: BYD Company Limited, Shenzhen, Guangdong (CN)

( * ) Notice: Subject to any disclaimer, the term of this patent is extended or adjusted under 35 U.S.C. 154(b) by 0 days.

(21) Appl. No.: 14/894,146

(22) PCT Filed: May 27, 2014

(86) PCT No.: PCT/CN2014/078485
§ 371 (c)(1),
(2) Date: Nov. 25, 2015

(87) PCT Pub. No.: WO2014/190891
PCT Pub. Date: Dec. 4, 2014

(65) Prior Publication Data

US 2016/0126615 A1 May 5, 2016

(30) Foreign Application Priority Data

May 29, 2013 (CN) ..... 2013 1 0206043
May 29, 2013 (CN) ..... 2013 2 0301939 U

(51) Int. Cl.
*H01Q 7/00* (2006.01)
*H01Q 1/24* (2006.01)
(Continued)

(52) U.S. Cl.
CPC ..... *H01Q 1/243* (2013.01); *H01Q 7/00* (2013.01); *H01R 24/52* (2013.01); *H01R 24/60* (2013.01); *H01R 2201/02* (2013.01)

(58) Field of Classification Search
CPC ..... H01Q 1/22; H01Q 7/00; H01Q 1/38; G06K 19/07728; G06K 19/07749
USPC ..... 343/870, 860, 715, 722; 455/575.7, 455/550.1
See application file for complete search history.

(56) References Cited

U.S. PATENT DOCUMENTS 5,604,507 A * 2/1997 Openlander ..... H01Q 1/50 343/715
7,202,829 B2 * 4/2007 Lan ..... H01Q 9/40 343/715

(Continued)

FOREIGN PATENT DOCUMENTS

CN 101577361 A 11/2009
CN 201584490 U 9/2010

(Continued)

OTHER PUBLICATIONS

International Search Report and Written Opinion for International Application No. PCT/CN2014/078485, dated May 29, 2013.

*Primary Examiner* — Huedung Mancuso
(74) *Attorney, Agent, or Firm* — Alston & Bird LLP

(57) ABSTRACT

A NFC antenna assembly and a mobile communication device are provided. The NFC antenna assembly including: a shell, a connecting device and an antenna circuit, the connecting device includes a female connector and a male connector configured to connect with the female connector via a snap-fit connection, and the antenna circuit formed on the shell and the male connector and defining first and second ends which are adapted to electrically connect with the female connector via the male connector.

14 Claims, 3 Drawing Sheets

(51) Int. Cl.
*H01R 24/52* (2011.01)
*H01R 24/60* (2011.01)

(56) References Cited

U.S. PATENT DOCUMENTS

2004/0062413 A1* 4/2004 Nassimi ..... H04R 1/1058
381/380
2007/0111749 A1* 5/2007 Biddulph ..... H01Q 1/38
455/550.1
2009/0143119 A1* 6/2009 De Vos ..... H01Q 1/084
455/575.7

FOREIGN PATENT DOCUMENTS

CN 102055063 A 5/2011
CN 203326079 12/2013

* cited by examiner

NFC ANTENNA ASSEMBLY AND MOBILE COMMUNICATION DEVICE COMPRISING THE SAME

CROSS-REFERENCE TO RELATED APPLICATION

This application claims priority to, and benefits of Chinese Patent Application Serial No. 201310206043.0 and No. 201320301939.2, both filed with the State Intellectual Property Office of China on May 29, 2013, the entire content of which is incorporated herein by reference.

FIELD

The present disclosure generally relates to field of near field communication (NFC), more particularly, relates to a NFC antenna assembly and a mobile communication device comprising the same.

BACKGROUND

Generally, NFC antenna has a communication distance less than 10 centimeters, and the NFC antenna can be interfered by metal material. Therefore, location and area of the NFC antenna are very restricted.

Traditional NFC antenna is manufactured by attaching a FPC (Flexible Printed Circuit) on a back shell of an electronic product (i.e. a cell phone), a feeding point, which is coated with gold, of the FPC is exposed to electrically connect with a shrapnel or a probe of a PCB (Printed circuit board). However, a contact resistance between the feeding point and one of the shrapnel and the probe may be unstable. Moreover, after a period of using, the shrapnel or the probe may be loose because frequently disassembling of the back shell, therefore, a connection between the feeding point and one of the shrapnel and the probe may be loose. In addition, there are many limitations for the NFC antenna, such as available space for housing the NFC antenna, location of a feeding point on a main board, interference with metal material and other components, and operation habit of user, which may restrict the overall layout of the product. Also, a thickness of the FPC may be large, thus it is difficult to achieve a trend of miniaturization.

SUMMARY

Embodiments of the present disclosure seek to solve at least one of the problems existing in the prior art to at least some extent, or to provide a consumer with a useful alternative.

Embodiments of the present disclosure provide a NFC antenna assembly, which includes: a shell; a connecting device comprising a female connector and a male connector disposed on the shell and configured to connect with the female connector via a snap-fit connection; and an antenna circuit formed on the shell and the male connector and defining first and second ends which are adapted to electrically connect with the female connector via the male connector.

Embodiments of the present disclosure also provide a mobile communication device, which comprises the NFC antenna assembly according to any one mentioned above.

With the NFC antenna assembly, an antenna signal may be outputted via the connector, therefore there are no limitations for mounting position of the NFC antenna and the outer main board, so that the NFC antenna and an outer main board may be arranged easily. In addition, with the snap-fit connection between the male connector and the female connector, the male connector and the female connector can be engaged reliably and stably, thus ensuring the transmission of signals therein effectively.

Additional aspects and advantages of embodiments of present disclosure will be given in part in the following descriptions, become apparent in part from the following descriptions, or be learned from the practice of the embodiments of the present disclosure.

DETAILED DESCRIPTION

Figure 1:
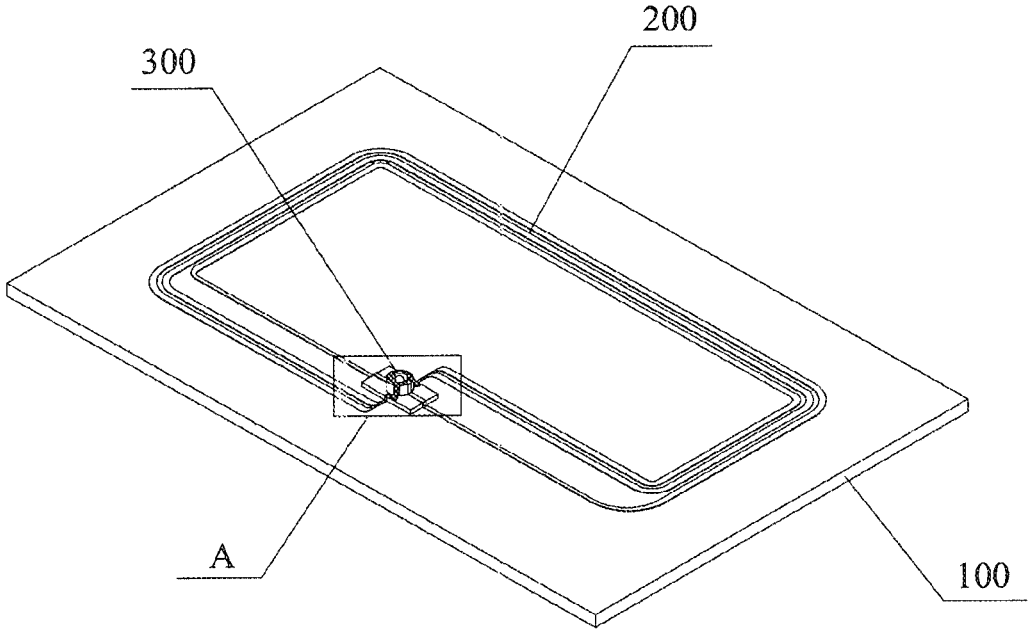
FIG. 1 is a schematic view of a NFC antenna assembly according to an embodiment of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, terms such as "first" and "second" are used herein for purposes of description and are not intended to indicate or imply relative importance or significance.

For the purpose of the present description and of the following claims, the definitions of the numerical ranges always include the extremes unless otherwise specified.

Figure 2:
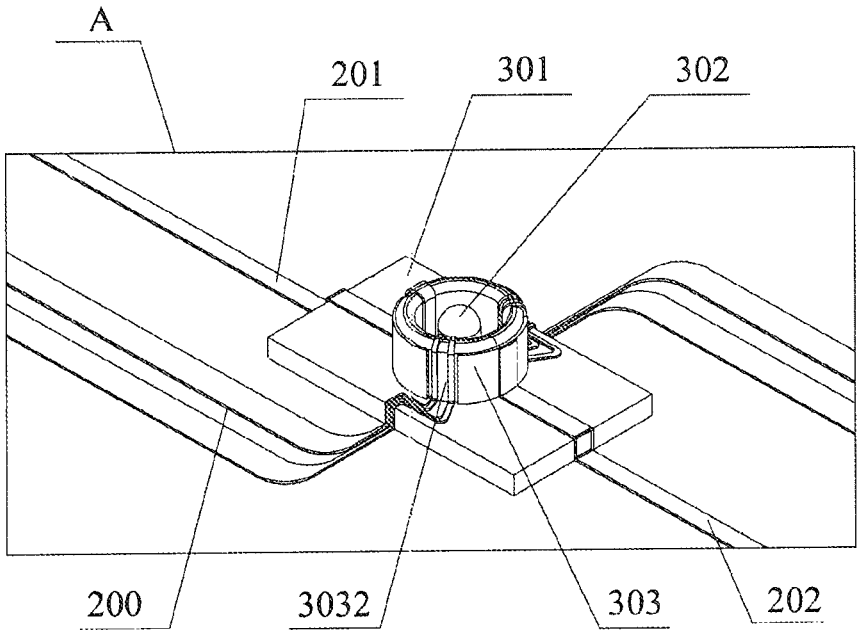
FIG. 2 is an enlarged schematic view of square A in FIG. 1.

As shown in FIG. 1 and FIG. 2, a NFC antenna assembly according to embodiments of the present disclosure is provided. The NFC antenna assembly includes: a shell 100, an antenna circuit 200 and a connecting device. The connecting device includes a male connector 300 formed on the shell 100 and a female connector 400 and the male connector 300 is configured to electrically connect with the female connector 400 via a snap-fit connection. The antenna circuit 200 is formed on the male connector 300 and the shell 100, and the antenna circuit 200 is electrically connected with the female connector 400 via the male connector 300.

Specifically, as shown in FIGS. 1-4, the male connector 300 comprises a base 301, first feeding part 302 and a second feeding part 303. The first and second feeding part 302, 303 are disposed on the base respectively. The antenna circuit 200 has a first end 201 connected with the first feeding part 302 and a second end 202 connected with the second feeding part 303.

Figure 3:
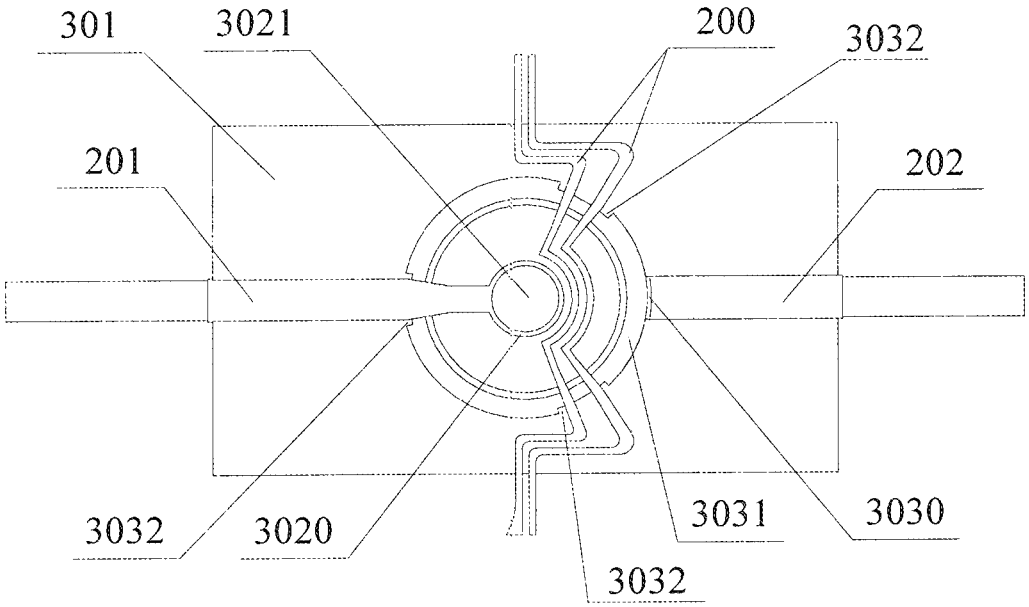
FIG. 3 is a top view of connection between a male connector and an antenna circuit of a NFC antenna assembly according to an embodiment of the present disclosure.

As shown in FIG. 2 and FIG. 3, the first feeding part 302 is configured as a column, correspondingly, the second feeding part 303 is configured as a cylinder and is disposed on periphery of the first feeding part 302, in other words, the first feeding part 300 is surrounded with the second feeding part 400.

The first feeding part 302 includes a columnar base body 3021 and a first copper layer 3020 formed on a surface of the columnar base body 3021. The second feeding part 303 includes a cylindrical base body 3031 and a second copper layer 3030 formed on a portion of an outer wall surface of the cylindrical base body 3031. As stated above, the first end 201 of the antenna circuit 200 is electrically connected with the first feeding part 302, that is, the first end 201 of the antenna circuit 200 is electrically connected with the first copper layer 3020; and the second end 202 of the antenna circuit 200 is electrically connected with the second feeding part 303, that is, the second end 202 of the antenna circuit 200 is electrically connected with the second copper layer 3030.

In embodiments of the present disclosure, the columnar base body 3021 and the cylindrical base body 3031 are electrically insulative, and the base 301 may also be made of insulating material. Thus, the base 301, the columnar base body 3021 and the cylindrical base body 3031 may be integrally formed via an injection molding. That is, the base 301, the columnar base body 3021 and the cylindrical base body 3031 may be integrally formed on the shell 100 via the injection molding. Alternatively, the base 301, the columnar base body 3021 and the cylindrical base body 3031 may be integrally formed with the shell 100 via the injection molding.

In some embodiments, the first copper layer 3020 is formed on the surface of the columnar base body 3021 by laser-radiating the surface of the columnar base body 3021 and electroless copper plating (i.e. chemical copper plating) on the radiated the surface of the columnar base body 3021.

The second copper layer 3030 is formed on the portion of the outer wall surface of the cylindrical base body 3031 by laser-radiating the portion of the outer wall surface of the cylindrical base body 3031 and electroless plating copper on the radiated portion of the outer wall surface of the cylindrical body 3031.

The antenna circuit is formed on the shell 100 and the base 301 by laser-radiating the shell 100 and the base 301 and electroless plating copper in radiated regions of the shell 100 and the base 301, so that the antenna circuit 200 is configured as a copper-coating circuit.

Thus, the antenna circuit 200 may have a high precision, the first end 201 of the antenna circuit 200 and the first copper layer 3020 may formed integrally, and the second end 202 of the antenna circuit 200 and the second copper layer 3030 may be formed integrally, so that the two ends of the antenna circuit 200 and the two feeding part 300, 400 may be well-contacted with each other to ensure the transmission performance of signals therebetween.

The methods of the laser-radiating and electroless copper plating are known by those with ordinary skills in the art, therefore detailed descriptions relating to the methods are omitted here.

In some embodiments, a radiated depth of each of the surface of the columnar base body 3021, the outer wall surface of the cylindrical base body 3031, the shell 100 and the base 301 is about 20 microns to about 100 microns. It should be noted that after the electroless copper plating, the other copper coating method which is commonly used in the art, such as copper plating, may be performed depend on actual need.

In some embodiments, each of the first copper layer 3020, the second copper layer 3030 and the antenna circuit 200 has a thickness of about 10 microns to about 40 microns. It should be noted that there are no limitations for a width of the antenna circuit 200, the antenna circuit 200 may be designed according to actual need.

Figure 4:
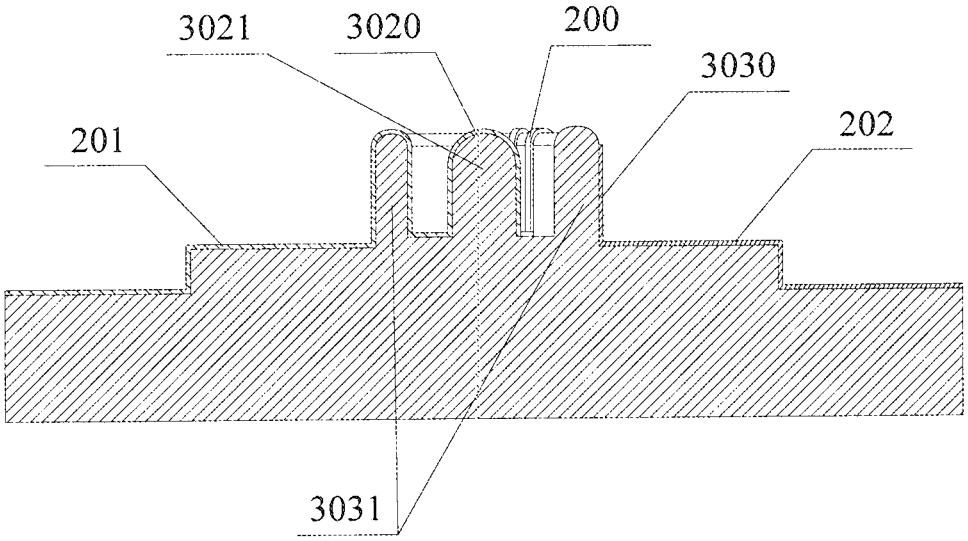
FIG. 4 is a cross-section view of connection between a male connector and an antenna circuit of a NFC antenna assembly according to an embodiment of the present disclosure.

As shown in FIGS. 2 to 4, the cylindrical base body 3031 includes a recess 3032 formed in the outer wall surface of the cylindrical base body 3031 and extended from a bottom of the cylindrical base body 3031 to a top of the cylindrical base body 3031, so as to correspond to paths of the antenna circuit 200 except for the second end 202.

The first end 201 of the antenna circuit 200 is extended from the shell 100 to the base 301, next extended into the recess 3032, and then extended along an inner surface of the cylindrical base body 3031 to the columnar base body 3021, so as to connect with the first copper layer 3020. The second end 202 of the antenna circuit 200 is extended from the shell 100 to the base 301, and then extended to the outer surface of the cylindrical base body 3031 to connect with the second copper layer 3030.

As shown in FIG. 3, with the recesses 3032, the first end 201 and the sections of the antenna circuit 200 passing through the male connector 300 cannot go beyond the outer surface of the cylindrical base body 3031, i.e. the first end 201 and the sections of the antenna circuit 200 are within the recess 3032, so that the first end 201 and the sections of the antenna circuit 200 cannot contact with an outer conductive layer 4011 of the female connector 400 when the female connector 400 and the male connector 300 are connected with each other.

It should be noted that the antenna circuit 200 is formed on the surface of the shell 100, in order to facilitate a layout of the antenna circuit 200, the bent portions of the sections of the antenna circuit 200 are located adjacent to the male connector 300 of the connector. Specifically, as shown in FIG. 3, the section of the antenna circuit 200, except for the first end 201 and the second 202 electrically connected to the first copper layer 3020 and the second copper layer 3030 respectively, cannot contact with the first copper layer 3020 and the second copper layer 3030 when they pass through the male connector 300 of the connector. Therefore, the sections of the antenna circuit 200 are arranged in the recess 3032 when contacting with the cylindrical base body 3031.

More particularly, when the sections of the antenna circuit 200 passes through the cylindrical base body 3031, the sections of the antenna circuit 200 cannot contact with both of the second copper layer 3030 and the outer conductive layer 4011 of the female connector 400. When the sections of the antenna circuit 200 pass through the columnar base body 3021, it should be guaranteed that the antenna circuit 200 cannot contact with the first copper layer 3020.

In another embodiment, holes (not shown) may be formed in the base 301 or the shell 100. For example, part of the antenna circuit 200 located on a first surface of the shell 100 passes through a first hole and extends along a second surface of the shell 100, and then passes through a second hole and extends along the first surface of the shell 100 again. Thus, the antenna circuit 200 may be arranged on two surfaces of the shell 100 via the holes.

Figure 5:
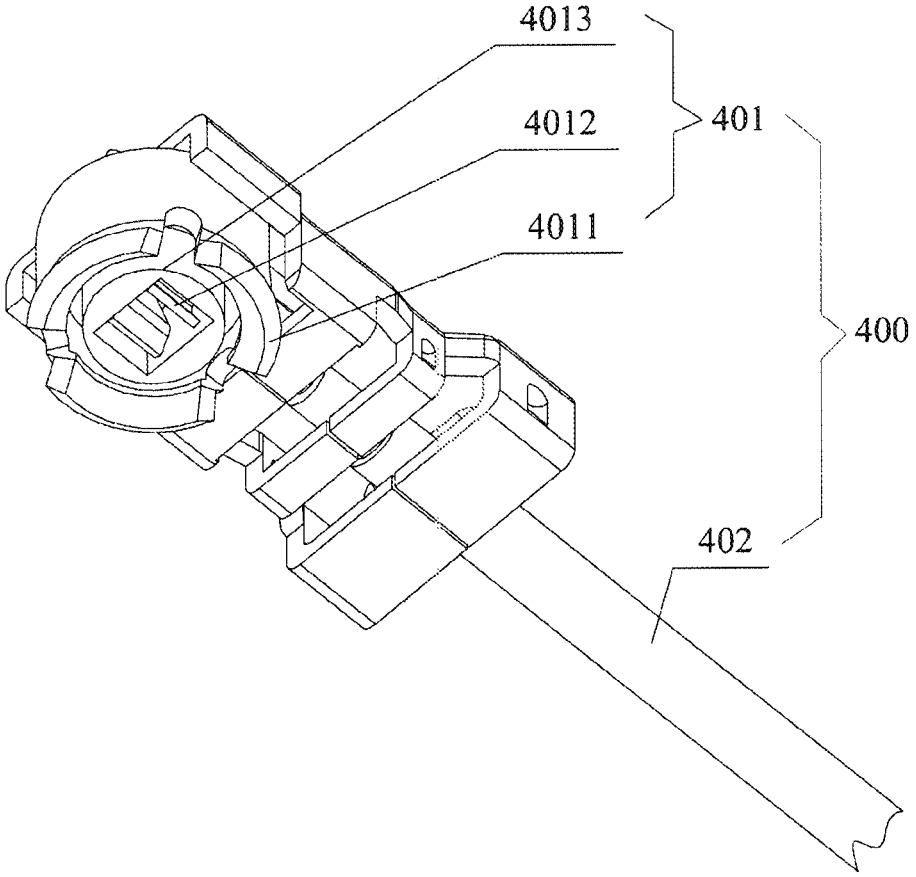
FIG. 5 is a schematic view of a female connector of a NFC antenna assembly according to an embodiment of the present disclosure.
Figure 6:
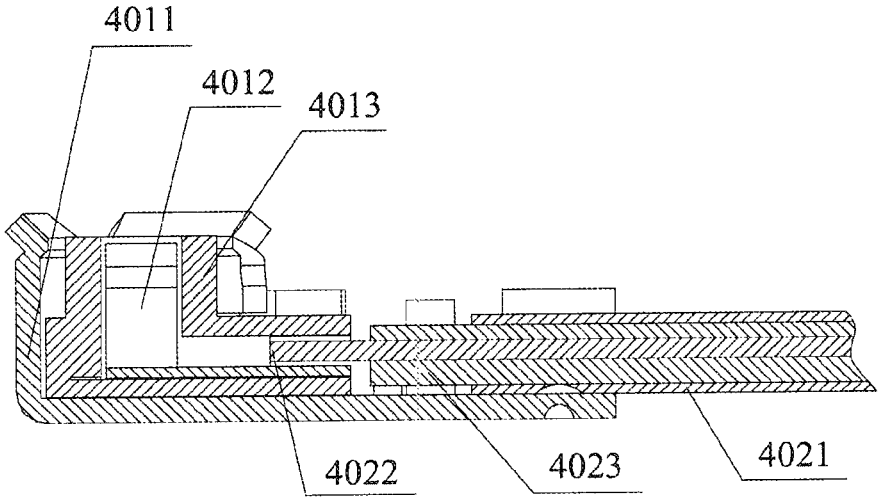
FIG. 6 is a cross-section view of a female connector of a NFC antenna assembly according to an embodiment of the present disclosure.

As shown in FIG. 5 and FIG. 6, the female connector 400 includes a connection part 401 configured to connect with the male connector 30), and a coaxial wire 402 electrically connected to the connection part 401.

In some embodiments, the connection part 401 includes an outer conductive layer 4011 configured to electrically connect to the first feeding part 302, an inner conductive layer 4012 configured to electrically connect to the second feeding part 303 and an insulating layer 4013 disposed between the outer conductive layer 4011 and the inner conductive layer 4012.

The coaxial wire 402 includes an outer coaxial wire 4021 electrically connected to the outer conductive layer 4011, an inner coaxial wire 4012 electrically connected to the inner conductive layer 4012 and a coaxial insulating layer 4023 disposed between the outer coaxial wire 4021 and the inner coaxial wire 4022.

As shown in FIG. 4, the outer conductive layer 4011 surrounds the inner conductive layer 4012. The shape of the inner conductive layer 4012 matches up that of the columnar base body 3021, and the shape of the outer conductive layer 4011 matches up that of the cylindrical base body 3031. In other words, the female connector 400 is adapted to be cooperated with the male connector 300, for example via the snap-fit connection between the connection part 401 and the connecting device. Therefore, two ends 201, 202 of the antenna circuit 200 are electrically connected to the outer coaxial wire 4021 and the inner coaxial wire 4022 respectively. It should be noted that the length and shape of the coaxial wire 402 may be designed according to actual needs, and the coaxial wire 402 may extend to a PCB main board to connect to a male connector of the PCB main board, therefore an antenna signal may be outputted.

With the coaxial wire 402, the mounting locations of the antenna circuit 200 and the PCB main board may be arranged randomly, there is no mutual effect between the antenna circuit 200 and the PCB main board, and layout of cell phone may not be restricted.

With the NFC antenna assembly, an antenna signal may be outputted via the connector, therefore there are no limitations for mounting position of the NFC antenna and the outer main board, so that the NFC antenna and an outer main board may be arranged easily. In addition, with the snap-fit connection between the male connector and the female connector, the male connector and the female connector can be engaged reliably and stably, thus ensuring the transmission of signals therein effectively.

Moreover, the antenna circuit 200 has a thickness of about 10 microns to about 40 microns, and the radiating depth is about 20 microns to about 100 microns, a portion of the antenna circuit 200 protruded over the surface of the shell 100 is less than 20 microns. Thus, the portion of the antenna circuit 200 extended over the surface of shell 100 can be ignored if comparing with entire thickness of the shell 100. So that the thicknesses of the shell 100 and the wave-absorbing layer can be considered as the thickness of the NFC antenna assembly according to embodiments of the present disclosure. Whereas, in a conventional FPC antenna assembly, the thickness of a FPC may be about 0.1 millimeters to about 0.5 millimeters, which may increase the thickness of the antenna assembly. Therefore, with the NFC antenna assembly according to embodiments of the present disclosure, an occupied space of the antenna assembly may be reduced greatly.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A NFC antenna assembly, comprising:

a shell;

a connecting device comprising a female connector and a male connector, the male connector being disposed on the shell, wherein the male connector is configured to connect with the female connector via a snap-fit connection; and an antenna circuit formed on the shell and the male connector, and defining first and second ends of the antenna circuit which are adapted to electrically connect with the female connector via the male connector.

2. The NFC antenna assembly of claim 1, wherein the male connector comprises:

a base;

a first feeding part disposed on the base and connected with the first end of the antenna circuit; and a second feeding part disposed on the base and connected with the second end of the antenna circuit.

3. The NFC antenna assembly of claim 2, wherein the first feeding part is configured as a column, and the second feeding part is configured as a cylinder surrounding the first feeding part.

4. The NFC antenna assembly of claim 3, wherein the first feeding part comprises a columnar base body and a first copper layer formed on a surface of the columnar base body, wherein the second feeding part comprises a cylindrical base body and a second copper layer formed on a portion of an outer wall surface of the cylindrical body;

wherein the antenna circuit is configured as a copper-coating circuit, the first end of the antenna circuit is electrically connected with the first copper layer, and the second end of the antenna circuit is electrically connected with the second copper layer.

5. The NFC antenna assembly of claim 4, wherein the first end of the antenna circuit is integral with the first copper layer, and the second end of the antenna circuit is integral with the second copper layer.

6. The NFC antenna assembly of claim 4, wherein the cylindrical base body is electrically insulative and a recess is formed in the outer wall surface of the cylindrical base body and extended from a bottom of the cylindrical base body to a top of the cylindrical base body;

wherein the first end of the antenna circuit is extended from the shell to the columnar base body by passing through the base, the recess and an inner wall surface of the cylindrical base body so as to connect with the first copper layer;

wherein the second end of the antenna circuit is extended from the shell to the outer wall surface of the cylindrical base body by passing through the base so as to connect with the second copper layer.

7. The NFC antenna assembly of claim 4, wherein the base, the cylindrical base body and the columnar base body are integrally formed via an injection molding.

8. The NFC antenna assembly of claim 4, wherein the first copper layer is formed on the surface of the columnar base body by laser-radiating the surface of the columnar base body and electroless plating copper on the laser-radiated surface of the columnar base body, wherein the second copper layer is formed on the portion of an outer wall surface of the cylindrical base body by laser-radiating the portion of the outer wall surface of the cylindrical base body and electroless plating copper on the laser-radiated portion of the outer wall surface of the cylindrical body; and wherein the antenna circuit is formed on the shell and the base by laser-radiating the shell and the base and electroless plating copper in laser-radiated regions of the shell and the base.

9. The NFC antenna assembly of claim 8, wherein a laser-radiated depth of each of the surface of the columnar base body, the outer wall surface of the cylindrical body, the shell and the base is about 20 microns to about 100 microns.

10. The NFC antenna assembly of claim 4, wherein each of the first copper layer, the second copper layer and the antenna circuit has a thickness of about 10 microns to about 40 microns.

11. The NFC antenna assembly of claim 2, wherein the female connector comprises:

a connection part configured to connect with the male connector, the connection part comprising:

an outer conductive layer configured to electrically connect to the first feeding part;

an inner conductive layer configured to electrically connect to the second feeding part;

an insulating layer disposed between the outer conductive layer and the inner conductive layer; and a coaxial wire electrically connected to the connection portion, the coaxial wire comprising:

an outer coaxial wire electrically connected to the outer conductive layer;

an inner coaxial wire electrically connected to the inner conductive layer; and a coaxial insulating layer disposed between the outer coaxial wire and the inner coaxial wire.

12. The NFC antenna assembly of claim 11, wherein the outer conductive layer surrounds the inner conductive layer.

13. The NFC antenna assembly of claim 1, further comprising a wave-absorbing layer covering the antenna circuit.

14. A mobile communication device, comprising the NFC antenna assembly according to claim 1.

* * * * *